United States Patent [19]

Hanaya

[11] 4,184,526

[45] Jan. 22, 1980

[54] DISC-SHAPED CHIPPER WITH DETACHABLE CUTTING MEMBERS

[75] Inventor: Morimasa Hanaya, Kure, Japan

[73] Assignee: Toyo Pulp Co., Ltd., Tokyo, Japan

[21] Appl. No.: 808,219

[22] Filed: Jun. 20, 1977

[30] Foreign Application Priority Data

Jun. 28, 1976 [JP] Japan ..... 51-75505

[51] Int. Cl.[2] ..... B27G 13/08

[52] U.S. Cl. ..... 144/235; 144/176; 144/241; 241/291

[58] Field of Search ..... 241/92, 93, 222, 291, 241/292.1, 224; 144/162, 172, 174, 176, 218, 230, 231, 220, 235, 326 A, 326 B, , 240, 241

[56] References Cited

U.S. PATENT DOCUMENTS

| | | | |
|---|---|---|---|
| 3,216,470 | 11/1965 | Nilsson | 144/230 |
| 3,304,970 | 2/1967 | Altosaar | 144/176 X |
| 3,330,315 | 7/1967 | Tomlinson | 144/162 R |
| 3,443,457 | 5/1969 | Nedsten | 144/240 |
| 3,461,931 | 8/1969 | Wexell | 144/220 X |
| 3,875,984 | 4/1975 | Plough | 144/162 R |

*Primary Examiner*—Robert L. Spruill
*Assistant Examiner*—W. D. Bray
*Attorney, Agent, or Firm*—Frank J. Jordan

[57] ABSTRACT

A chipper comprised of a disk body, a driving shaft mounted on the disk body for rotating it and at least one spout connected with the casing and a plurality of cutting blades located on the disk body along at least one spiral path extending from the center to the periphery of the disk body, each of the cutting blades having main and auxiliary cutting edges which are positioned and connected angularly to each other, the main cutting edge being inclined to the surface of the disk body with such an angle that one end of the main cutting edge is positioned at a height corresponding to the thickness of chips to be cut with the connecting edge between the main edge and corresponding auxiliary cutting edge positioned two times as high as the one end of the main cutting edge.

6 Claims, 15 Drawing Figures

DISC-SHAPED CHIPPER WITH DETACHABLE CUTTING MEMBERS

BACKGROUND OF THE INVENTION

The present invention relates to a disk-typed chipper.

A drum-typed chipper for producing chips from logs having a relatively large diameter is well knwon, for example, by Japanese Patent Publication No. 7081/1974. In such type of chipper, the drum is adapted to receive the cut chips at the inner peripheral surface thereof so that they tend to lie flat on the inner surface of the drum due to centrifugal force at a raised rotating speed. In this case, it is difficult to remove the cut chips from the interior of the drum. For such reason, the rotating speed of the drum chipper is normally limited to 25–120 rpm. Consequently, the drum chipper has a low productivity and high price while it is large in structure. The drum chipper also has a disadvantage in that it requires logs to be cut which have been pre-cut to a predetermined length. Moreover, the drum chipper has a further disadvantage in that logs are fed to the cutter thereof through a converged hopper. This causes the logs to be cut under compression so that the logs will be damaged. Furthermore, it is difficult to obtain chips having the desired thickness as they expand after cutting. Finally, the logs are cut by the drum chipper along the arcuately curved periphery thereof so that the chips will be curled. This will reduce the compaction rate of chips that can be charged in the cooking digester.

As is apparent from the foregoing, the drum-typed chipper cannot produce chips of uniform size and damage the wood fibers.

DETAILED DESCRIPTION

It is the main object of the present invention to provide a chipper having a novel structure in which the disadvantages in the prior art drum-typed chipper will be overcome and the productivity of chips can be improved.

Another object of the present invention is to provide a chipper by which chips of uniform size can be produced without damaging the wood fibers thereof to improve the quality of the wood pulp.

Still another object of the present invention is to provide a chipper of a simple and inexpensive structure which can obtain chips cheaper in cost under the higher productivity thereof.

A further object of the present invention is to provide a chipper which can reduce the cost of chips to be produced by using improved cutting blades stronger in construction, particularly at the connecting edge between main and auxiliary cutting edges thereof.

A further object of the present invention is to provide a chipper which requires less energy with lower noise.

In order to accomplish the above objects, a chipper according to the present invention is comprised of a disk body, a driving shaft mounted on the disk body for rotating it and a plurality of cutting blades detachably mounted on the disk body along at least one spiral path extending from the center to the periphery of the disk body, each of the cutting blades having main and auxiliary cutting edges which are positioned and connected angularly to each other, the cutting blades protruding from the surface of said disk body in such a manner that the main cutting edges are inclined to the surface of the disk body with a predetermined angle. In such an arrangement, logs to be cut are fed in parallel with the main cutting edges or the auxiliary cutting edge to be engaged continuously by the cutting blades thereon. Therefore, the logs can be completely chipped.

According to the present invention, the chipper is not restricted under low range in the rotating speed as in the drum-typed chipper and can feed the log axially with its grain. The disk body of the present invention can be rotated in the range of from 700 rpm to 900 rpm.

The present invention will now be described by way of example with reference to the accompanying drawings in which.

Figure 1:
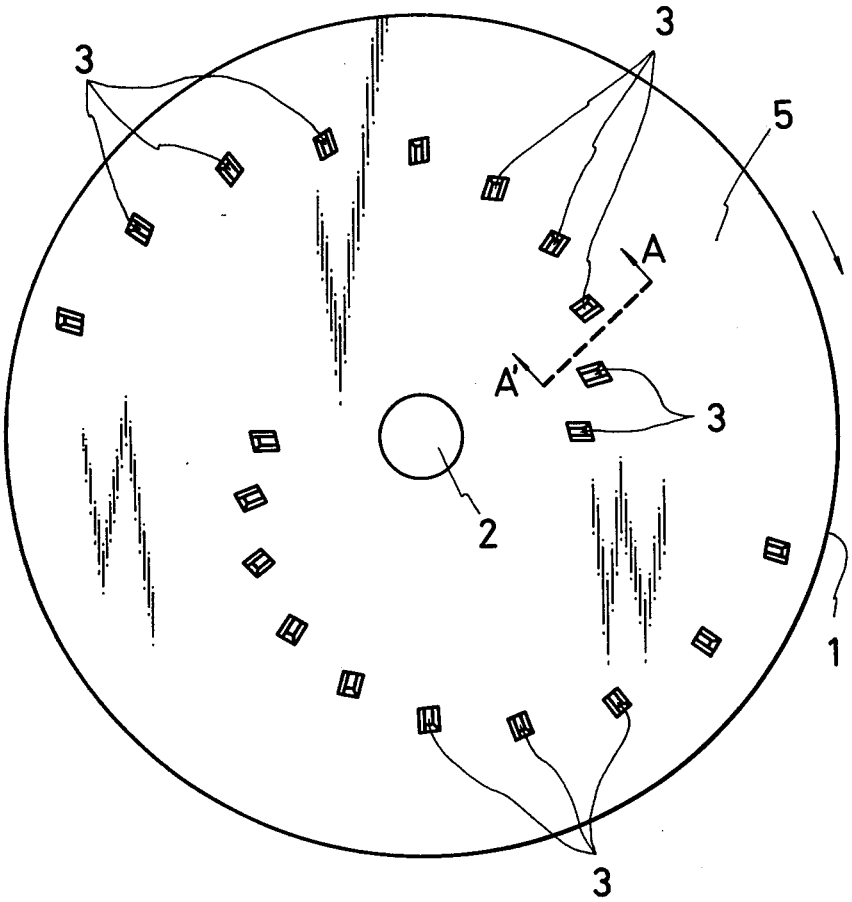
FIG. 1 is a plan view showing a disk body having a plurality of cutting blades mounted thereon along two spiral paths extending from the center to the periphery of the disk body.

Referring to FIG. 1, a chipper according to the present invention, is comprised of a disk body 1 having flat surfaces parallel to each other (one thereof shown by numeral 5), a driving shaft 2 mounted on the disk body 1 with the axis thereof aligned with the center of rotation in the disk body, and a plurality of cutting blades 3 detachably mounted on the disk body along two spiral paths extending from the center to the periphery of the disk body 1. In this arrangement, the disk body 1 is rotated by the driving shaft 2 in a direction as shown by the arrow of FIG. 1, that is, in such a direction that each of the spiral paths approaches from the center of the disk body 1 to the periphery thereof.

Figure 2:
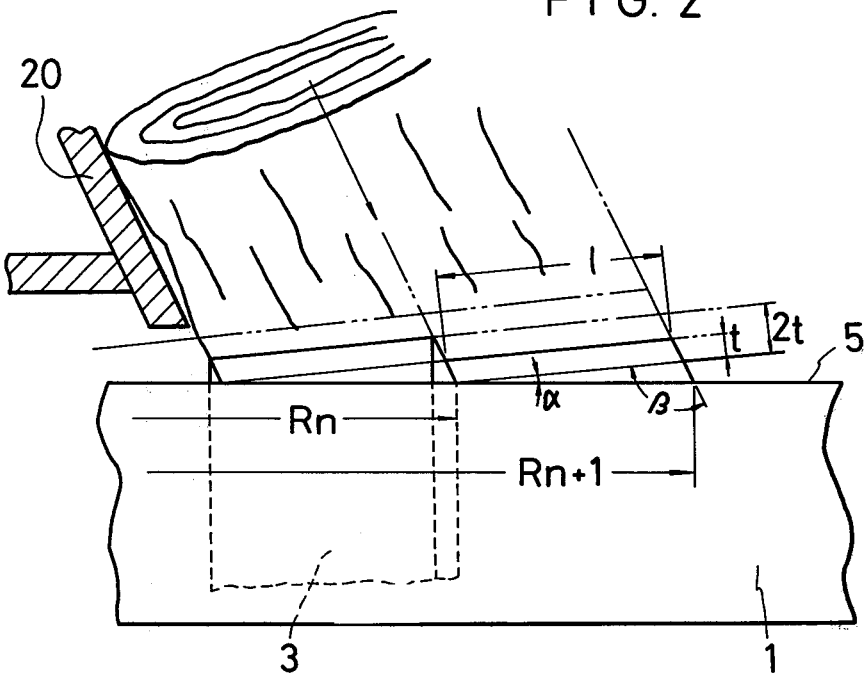
FIG. 2 is a sectional view taken along a line A - A' in FIG. 1, showing the relationship between some cutting blades and a log to be chipped.
Figure 3:
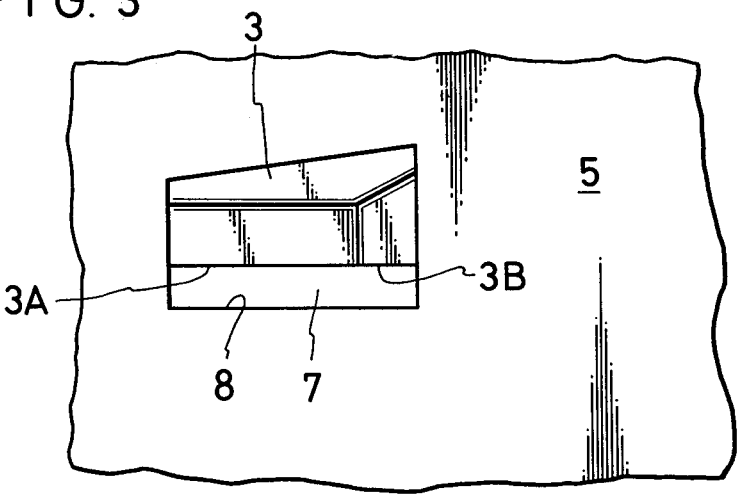
FIG. 3 is an enlarged plan view showing one of the cutting blades on the disk body.
Figure 4:
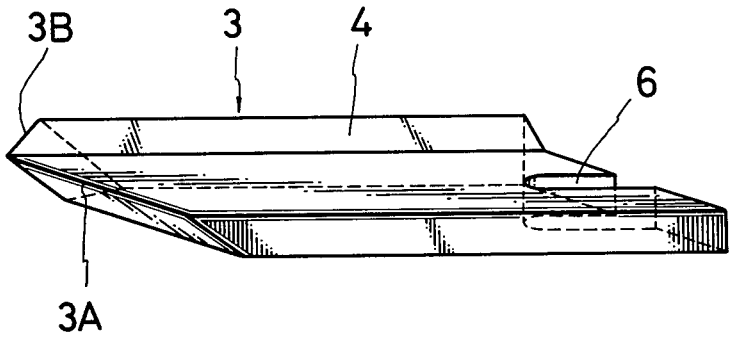
FIG. 4 is a perspective view of a cutting blade used in the present invention.

Referring to FIGS. 2 through 4, each of the cutting blades 3 includes a substantially rectangular plate, one end of which has a main cutting edge 3A obliquely formed therein. The rectangular plate has a sloping portion 4 extending substantially over the length thereof along the one side of the plate. The sloping portion 4 has at its front end an auxiliary cutting edge 3B formed therein which is connected angularly to the main cutting edge 3A and inclined backwardly. The angle between the main and auxiliary cutting edges 3A and 3B may be determined as required. The plate also has at its rear end a slot 6 formed therein which serves to mount it on the disk body in a manner as described hereinafter.

The disk body 1 includes a plurality of openings 8 formed therein which serve to mount the cutting blades 3 on the disk body 1. Each of the cutting blades 3 is mounted in the respective opening 8 in such a manner as described hereinafter with reference to FIG. 5. The cutting blades mounted in the opening 8 protrud from the surface 5 of the disk body 1 such that the main cutting edge 3A is inclined with respect to the surface 5 of the disk body 1 by an angle $\alpha$ (see FIG. 2). The protrusion of the blades 3 is such that the main cutting edge 3A has one end positioned at a height corresponding to the thickness of chips to be cut with the other end being positioned two times as high as the one end of that main cutting edge. The other end of the main cutting edge 3A is at the connection between the main and auxiliary cutting edges 3A and 3B. Furthermore, the main and auxiliary cutting edges of the blades 3 are all oriented substantially in the direction of rotation of the disk body 1. In the embodiment as shown in the drawings, all of the main cutting edges 3A are positioned in a plane including any radial line in the surface 5 of the disk body 1.

Figure 5:
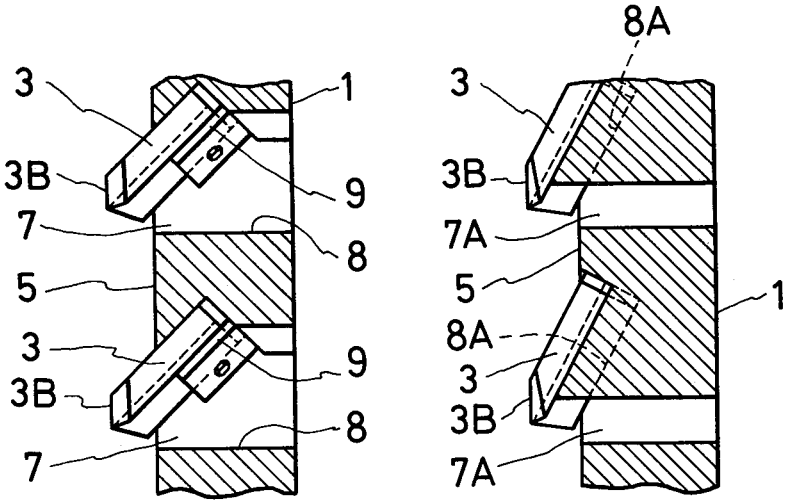
FIG. 5 illustrates two arrangements of how the cutting blades are mounted on the disk body.

FIG. 5 shows two ways of how the cutting blades 3 are mounted on the disk body 1. In the left-hand portion of FIG. 5, each cutting blade 3 has its inner end fastened by means of a keep plate 9 within the mounting opening 8. Between the cutting edges and the opposed wall of the opening 8 there is a clearance 7 for passing the cut log portion therethrough.

As shown in the right-hand portion of FIG. 5, the disk body 1 may be provided with mounting recesses 8A in place of the mounting openings 8. Each of the cutting blades 3 is mounted in the respective recess 8A by means of a suitable fastening means such as the keep plate 9 in the left-hand portion of FIG. 5. The disk body 1 is also provided with apertures 7A for passing the cut log portion therethrough. In the latter case, the main and auxiliary cutting edges of each blades 3 are formed more sharply since the blade is inclined more acutely to the surface 5 of the disk body 1.

Figure 7:
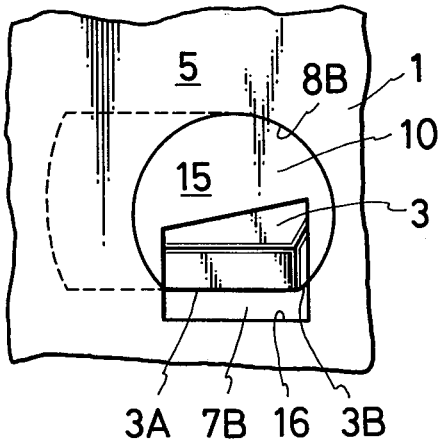
FIG. 7 is an enlarged plan view showing a further way of how each cutting blade is mounted on the disk body.
Figure 8:
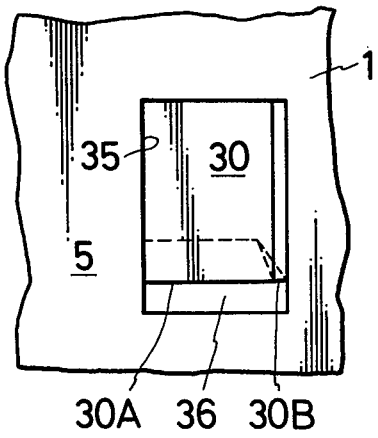
FIG. 8 is a view similar to FIG. 7, showing another cutting blade mounted on the disk body.
Figure 9:
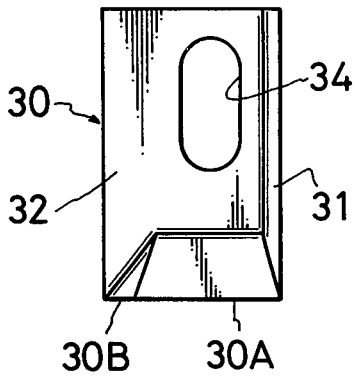
FIG. 9 is a plan view of the cutting blade shown in FIG. 8.
Figure 10:
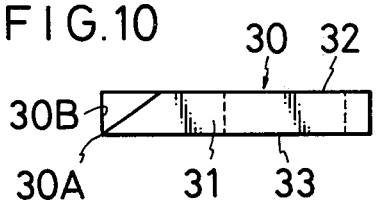
FIG. 10 is a side view thereof.
Figure 11:
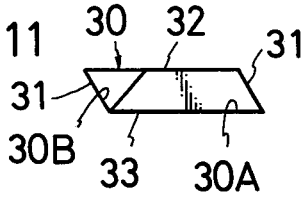
FIG. 11 is an end view thereof.
Figure 12:
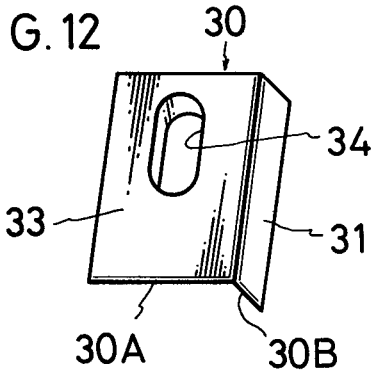
FIG. 12 is a perspective view from the surface side thereof.
Figure 13:
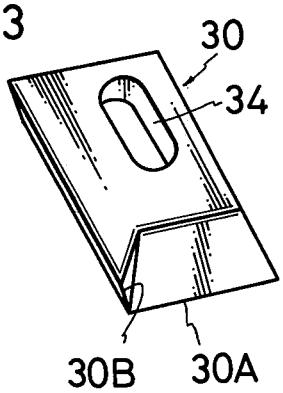
FIG. 13 is a perspective view from the back side thereof.
Figure 14:
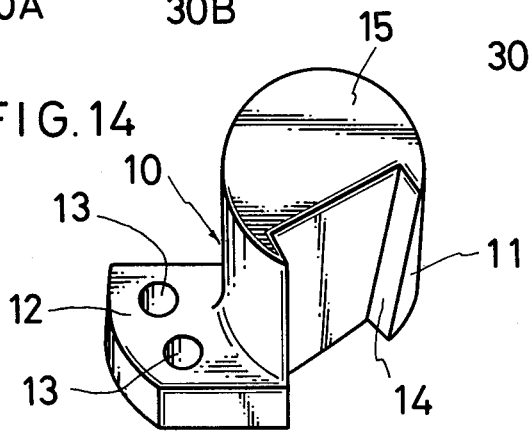
FIG. 14 is a perspective view of a mounting member used when the cutting blade is mounted on the disk body in such a manner as shown in FIG. 7.

The cutting blades 3 may be mounted on the disk body 1 by using a mounting member 10 shown in FIGS. 7 and 14. This mounting member 10 includes a substantially cylindrical body 11 and a bracket portion 12 formed therein laterally from the bottom of the cylindrical body 11 and having apertures 13 for passing through any suitable fastening means such as bolt, screw and the like. The cylindrical body 11 is provided with a side groove 14 for mounting the cutting blade 3 thereon. As shown in FIG. 7, the cylindrical body 11 of each mounting member 10 is inserted into the corresponding opening 8B formed in the disk body 1 and fixed therein by fastening the bracket portion 12 to the disk body 1 with the top face 15 thereof being flush with the surface 5 of the disk body 1. The cutting blade 3 is mounted within the groove 14 of the mounting member 11 with the cutting edges thereof protruded from the top face 15 of the mounting member 10 in such a manner that the main cutting edges are inclined to the top face 15 with an angle $\alpha$. The opening 8B of the disk body 1 is provided with a recess 16 which forms a clearance 7B for passing the cut log portion therethrough between the cutting edges of the blade 3 and the inner wall of the opening 8B.

Referring again to FIG. 2, the chipper of the present invention is provided with at least one spout having a guide plate 20 for guiding a log fed to the disk body 1. The guide plate 20 is disposed substantially parallel to a plane through which each of the auxiliary cutting edges passes. The log is fed axially along the guide plate 20 to the disk body 1 being rotated by the driving shaft 2 (FIG. 1). When the log is engaged by the disk body 1, the main cutting edges 3A of the cutting blades 3 cut the log across the wood grains thereof and the auxiliary cutting edges 3B cut off the log into strip-like wood pieces not parallel to the direction of wood grain. Each strip-like wood piece has a width corresponding to the length of the main cutting edge 3A and a thickness corresponding to the protrusion of the main cutting edge from the surface 5 of the disk body 1. The wood pieces are abruptly bent and split along the wood grain as it is passes through the clearances 7 to form a plurality of chips having its section in the form of a parallelogram by the impact action of the disk body 1. The length of its chip is the same as $t \times \text{cosec.}\gamma \times \text{cosec.}(180° - \beta)$ where $\gamma$ is the minimum angle between the wood grain and body disk.

Figure 15:
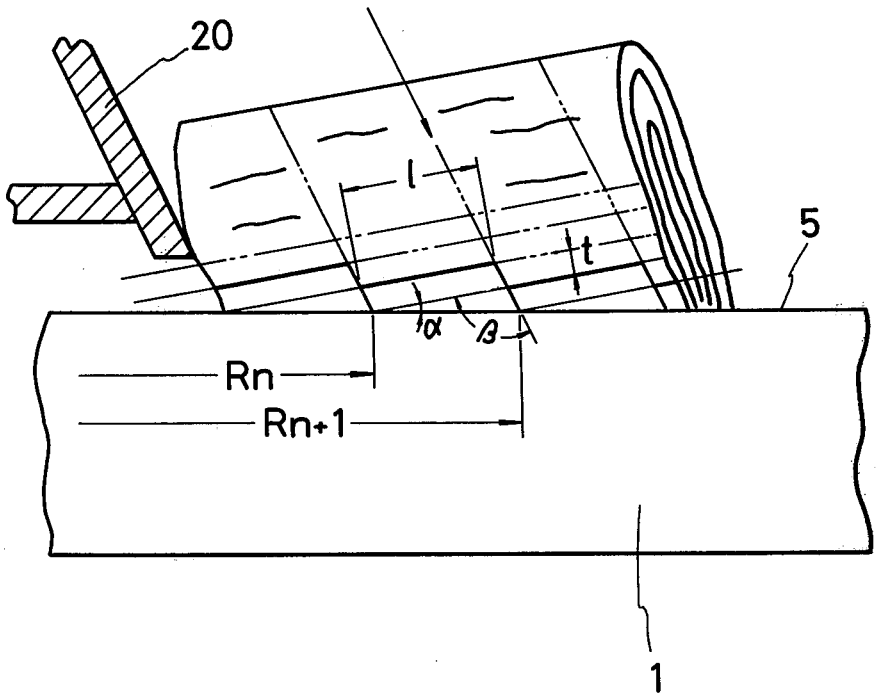
FIG. 15 is a view similar to FIG. 2, showing a further way of how the log is fed to the disk body.

FIG. 15 shows another way of feeding the log to the disk body 1 by using at least one spout having a guide plate 20. The wood waste from the saw mills or the venner plant such as short end log is fed sidewise to the disk body 1. When the log is engaged by the disk body 1, the main cutting edge 3A of each blade 3 cuts the log parallel to the wood grains thereof and the auxiliary cutting edge 3B thereof cuts the log across the wood grains thereof. In this manner, the slicing strip has a width corresponding to the length of the main cutting edge 3A and a thickness corresponding to the protrusion of the main cutting edge from the surface 5 of the disk body 1. The slicing strip then splits along the wood grain as it is passing through the clearances 7 to form a plurality of chips.

Figure 6:
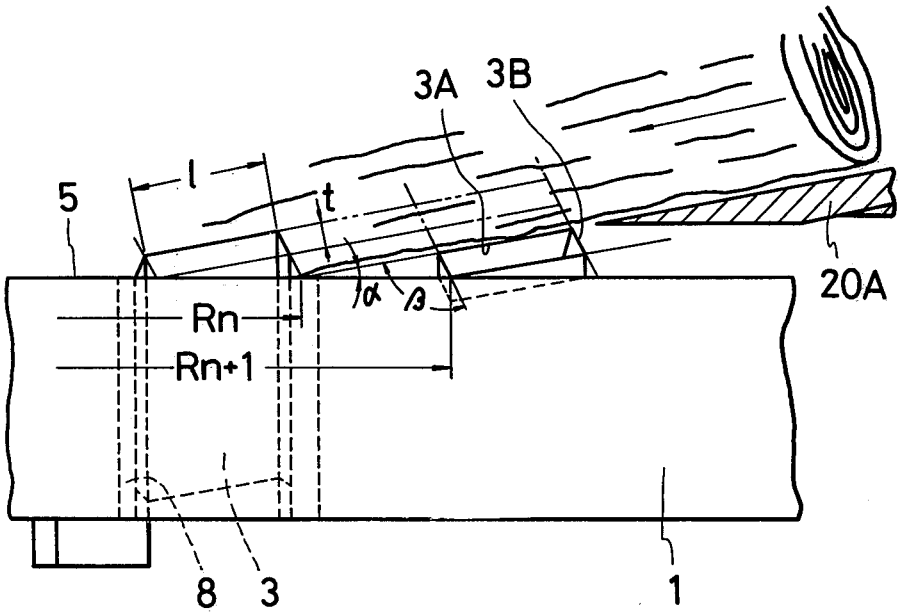
FIG. 6 is a view similar to FIG. 2, showing another way of how the log to be cut is fed to the disk body.

In FIG. 6, the guide plate 20A is disposed substantially parallel to a plane through which each of the main cutting edges 3A passes. The wood waste from the saw mills such as the slab or the branch is fed axially along the guide plate 20A to the disk body 1 in such a manner that it is cut off sidewise and the chips are made as described with reference to FIG. 15.

Now, supposing that an angle between the surface 5 of the disk body 1 and the main cutting edge 3A of any blade 3 is $\alpha$ and the thickness of the wood piece cut from the lot is t, the radial distance between the adjacent cutting blades is represented by the following formula:

$$R_{n+1} - R_n = t \cdot \text{cosec. } \alpha$$

where $R_n+1$ is a distance from the center of the disk body to the outer side of any cutting blade, and $R_n$ is a distance from the center of the disk body to another cutting blade positioned at the side near the center of the disk body in the same spiral path.

Next, supposing that the rotating speed of the disk body is N, the number of the spiral path Z, the minimum angle between the wood grain and the disk body $\gamma$, the angle between the main and auxiliary cutting edges $\beta$, and the length of the main cutting edge l, the chipper according to the present invention has the following velocity V as the log is cut axially to the disk body:

$$V=N\cdot l\cdot Z$$

when the log is fed axially to the disk body in a direction substantially parallel to a plane through which the main cutting edges pass such as in the case of FIG. 6, or $$V=N\cdot t\cdot z\cdot \text{cosec.}(180^\circ-\beta)\cdot \text{cosec.}\gamma$$

$$l=t\cdot[\cot\alpha-\cot(180^\circ-\beta)]$$

when the log is fed axially to the disk body in a direction substantially parallel to a plane through which the auxiliary cutting edges pass such as in the case of FIG. 2, or $$V=N\cdot T\cdot Z\cdot \text{cosec.}(180^\circ-\beta)\cdot \text{cosec.}\gamma$$

when the short log is fed sidewise in a position that wood grain is substantially parallel to a plane through which the main cutting edges pass such as in the case of FIG. 15.

Referring to FIGS. 8 through 13, a cutting blade 30 illustrated herein comprised of a plate having a substantially rectangular elevational shape and a cross-sectional shape of a parallelogram. The plate includes two side faces 31 parallel to each other and inclined to the top and bottom faces 32 and 33 of the plate. At one end of the plate, it is machined in a suitable manner to form a main cutting edge 30A and an auxiliary cutting edge 30B disposed angularly to the main cutting edge 30A. The plate is provided with a mounting slot 34 formed therein at the opposite end thereof. This cutting blade 30 is mounted within a rectangular opening 35 provided in the disk body 1 in a suitable manner to form a clearance 36 between the cutting edges of the blade and the inner end wall of the opening 35. The cutting blades 30 are positioned and operated in a manner similar to the cutting blade 3 in FIG. 4 so that the same advantages will be substantially obtained.

It should be understood from the foregoing that the chipper according to the present invention, can produce effectively chips of uniform size and shape while requiring less energy for operating with lower noise since the load on the disk body is smoothed by the cutting blades distributed broadly over the disk body.

Although some preferred embodiments of the present invention have been described with reference to the accompanying drawings, it is to be understood that the present invention may be carried out with many changes and modifications by those skilled in the art. For example, the chipper may be provided with cutting blades having main and auxiliary cutting edges of a length two times as that of the cutting blades as shown by solid lines in FIG. 1 and located alternately with said cutting blades having the longer edges. Further, the disk body in the present invention may be rotated in a direction opposite to that shown by the arrow in FIG. 1. In such a case, the cutting blades must be similarly oriented to an opposite direction as in FIG. 1. Furthermore, the number of the spiral path in which the cutting blades are located may be increased as desired so that an increased rate of cutting will be obtained. Moreover, the main cutting edge of each cutting blade may be disposed angularly to a plane including any radial line in the disk so that the cutting area of the log will be slightly increased. Still further, a chipper may include three types of spout means at the same time, namely a spout means having a guide plate located substantially parallel to a plane through which each of the main cutting edges passes such as in the case of FIG. 6 and another spout means having a guide plate located substantially parallel to a plane through which each of the auxiliary cutting edges passes such as in the case of FIGS. 2 or 15. By doing this, different types of logs can be chipped by one and single chipper.

What we claim are:

1. A chipper comprising a disk body, a driving shaft mounted on said disk body with the longitudinal axis of said shaft aligned with the center of rotation in said disk body, said disk body having a flat planar surface, a plurality of cutting blade members detachably mounted on said disk body and disposed along at least one spiral path which extends on said surface of said disk body from the center to the periphery of said disk body, said blade members being spaced apart from one another with a predetermined distance, each of said cutting blade members including main and auxiliary cutting edges which are positioned and joined angularly to each other at a respective one end thereof of each said cutting edges, the main cutting edges of said blade members being oriented substantially in the direction that said disk body is rotated, each of said main cutting edges protruding from said flat planar surface of said disk body such that said main cutting edge is positioned above said flat planar surface with the other end thereof located at a distance above said flat planar surface corresponding to the thickness of chips to be cut, the juncture between the main and auxiliary edges being located twice the distance above said flat planar surface as said other end of said main cutting edge.

2. The chipper as set forth in claim 1, wherein the main cutting edge of each blade member is positioned in a plane including any radial line in said disk body.

3. The chipper as set forth in claim 1, wherein the main cutting edge of each blade body is positioned to incline with respect to a plane lincluding ay radial line in said disk body.

4. The chipper as set forth in claim 1 further comprising at least one spout means for inducting a log to be cut to said disk body, said spout means having a guide plate located substantially parallel to a plane through which each of said main cutting edges pass.

5. The chipper as set forth in claim 1 further comprising at least one spout means for inducting a log to be cut to said disk body, said spout means having a guide plate located substantially parallel to a plane through which each of said auxiliary cutting edges pass.

6. The chipper as set forth in claim 1 further comprising at least one spout for feeding a log to be cut to said disk body, said spout being arranged to feed the log such that the longitudinal axis of the log is disposed at an acute angle relative to said flat planar surface of said disk body.

* * * * *